United States Patent [19]

Krigmont et al.

[11] Patent Number: 4,987,839

[45] Date of Patent: Jan. 29, 1991

[54] REMOVAL OF PARTICULATE MATTER FROM COMBUSTION GAS STREAMS

[75] Inventors: Henry V. Krigmont, Seal Beach; Everett L. Coe, Jr., Downey, both of Calif.

[73] Assignee: Wahlco, Inc., Santa Ana, Calif.

[21] Appl. No.: 523,312

[22] Filed: May 14, 1990

[51] Int. Cl.[5] ..... F23J 3/00

[52] U.S. Cl. ..... 110/216; 55/2; 55/5; 55/105; 110/344; 110/345

[58] Field of Search ..... 110/216, 217, 343, 344, 110/345, 185, 186; 55/2, 105, 5

[56] References Cited

U.S. PATENT DOCUMENTS

| | | | |
|---|---|---|---|
| 4,490,159 | 12/1984 | Matts | 55/2 |
| 4,779,207 | 10/1988 | Woracek et al. | 55/105 X |
| 4,793,268 | 12/1988 | Kukin et al. | 110/343 |
| 4,885,139 | 12/1989 | Sparks et al. | 55/2 X |

*Primary Examiner*—Edward G. Favors

*Attorney, Agent, or Firm*—Howard Sandler; Gregory O. Garmong

[57] ABSTRACT

Unburned particulate matter is removed from a combustion gas stream by adding a conditioning agent to modify the resistivity of the particulate matter and passing the conditioned combustion gas stream through an electrostatic precipitator whose precipitating elements are energized with an intermittent applied voltage. The addition of conditioning agent and the precipitating voltage signal are mutually optimized. A controller receives measurement signals from sensors that monitor the total flow rate of particulate matter in the gas stream before the electrostatic precipitation treatment, and the concentration of particulate matter in the gas stream after the treatment. Performance of the system may be optimized according to selected combinations of variables.

19 Claims, 3 Drawing Sheets

REMOVAL OF PARTICULATE MATTER FROM COMBUSTION GAS STREAMS

BACKGROUND OF THE INVENTION

This invention relates to the economical removal of particles from combustion gas streams such as those of power plants, and, more particularly, to an approach for mutually optimizing the performance of the gas conditioning system and the electrostatic precipitator.

Conventional (non-nuclear) power plants that burn oil or coal produce unburned particulate matter that is entrained in the combustion gas stream. The particulate matter would, if permitted to flow up the exhaust stack and into the environment, deposit around and downwind of the plant in an unsightly, environmentally unacceptable manner. It is therefore standard practice to remove a large portion of the particulate matter from the combustion gas before the gas is exhausted, through the use of filters and/or electrostatic precipitators. The present invention relates to the use of electrostatic precipitators to remove the particulate matter.

The electrostatic precipitator applies an electrostatic charge to the particles in the gas stream. The combustion gas bearing the charged particles passes between oppositely charged electrode plates, causing the particles to be attracted to one of the electrodes by an electrostatic force. The particles adhere to the collecting electrode plates, and the mass of particles is periodically removed from the plates.

Under some circumstances, the electrical resistivity of the particles may be excessively high, so that the electrical resistivity of the particle mass adhering to the collecting electrode plates is also excessively high. The particle mass produces a high series electrical resistance that reduces the precipitation current that flows between the oppositely charged electrodes, in the manner of an insulator layer, thereby reducing the efficiency of the particle collection. A corona discharge in the collected layer of particulate matter often develops, giving the phenomenon its name of "back corona".

A number of different techniques have been developed to improve the efficiency of electrostatic precipitators. In one, conditioning agents are added to the combustion gas stream to modify and reduce the resistive character of the particles. In another, the electrostatic precipitator is placed on the hot side of the system combustion gas heat exchanger. At this temperature, the resistivity of the particulate is sufficiently low that it can be processed properly. In yet another approach, various types of special electrostatic precipitators have been devised.

One promising approach to improved efficiency of the electrostatic precipitator is to vary the duty cycle of the voltage applied to the precipitating elements of the electrostatic precipitator. Since the development of the corona effect is related to the capacitance of the particle mass on the collecting electrode, there is a time delay that is on the order of 0.1 to 2 seconds required to develop the adverse effects. It is known that the back corona effect may be reduced or avoided by energizing (applying a voltage between) the collection electrodes for a short period of time, and then deenergizing the electrodes before the back corona effect can develop. The electrodes are then reenergized and the process repeats. Experimental results have shown that both the collection efficiency of the particulate matter and also the power efficiency of the electrostatic precipitator can be improved by the use of such an intermittent voltage approach.

However, the success of the intermittent energization technique in achieving improved plant performance varies with the nature of the fuel being burned to form the combustion gas stream. There is a need for an approach to improving the operation of combustion gas cleanup systems, making the intermittent energization technique more broadly applicable, and achieving more nearly optimal system performance. The present invention fulfills this need, and further provides related advantages.

SUMMARY OF THE INVENTION

The present invention provides an apparatus and method for enhancing the removal of particulate matter from combustion gas streams. With this approach, the beneficial effects of the intermittent energization technique for electrostatic precipitator operation are mutually optimized with the benefits of combustion gas conditioning. Increased removal of particulate matter and reduced power consumption of the electrostic precipitator are achieved, over a wide range of types of fuels. The approach permits optimal conditions to be approached rapidly and then maintained closely over extended periods of time.

In accordance with the invention, apparatus for removing particulate matter from a combustion gas stream that is passed through an electrostatic precipitator having precipitating elements therein comprises first means for selectively injecting a controllably variable amount of a conditioning agent into a combustion gas stream at a location prior to the entry of the combustion gas into an electrostatic precipitator; second means for establishing the duty cycle of the power provided to a precipitating element in the electrostatic precipitator; third means for measuring the relative particulate content of the combustion gas stream after it leaves the electrostatic precipitator; and fourth means for controlling the first means and the second means in response to the measurement derived from the third means.

The performance of the intermittent excitation operation of electrostatic precipitators depends upon the nature of the fuel burned. For example, different types of coal can be processed through such an electrostatic precipitator system with varying degrees of success. It has previously been the practice simply to accept whatever benefits available when a particular type of fuel was burned and then processed through the electrostatic precipitator operating in the intermittent operation mode. When another type of fuel was burned, its benefits were accepted. There has been no capability to modify the character of the particulate matter produced by different types of coal so as to yield even greater benefits.

The present invention includes a control system that permits joint optimization of the addition of a conditioning agent such as sulfur trioxide to the combustion gas stream, and the duty cycle of the electrostatic precipitator operated in the intermittent excitation mode. The concentration of particulate matter in the cleaned combustion gas leaving the electrostatic precipitator is measured by a sensor, such as an opacity meter. The operating parameters are varied so as to achieve an optimized system performance, which optimization may take any of several forms that are preselected as a figure of merit. Optionally, the total flow of particulate matter in the combustion gas stream may be measured directly or with a proxy such as boiler load, and this information used to reduce the lag time required to reach optimized performance after a change in system demand, for example.

Further in accordance with the invention, a process for removing particulate matter from a combustion gas stream that is passed through an electrostatic precipitator comprises the steps of injecting a controllable flow of a conditioning agent to a flowing combustion gas stream at a location prior to the entry of the combustion gas into an electrostatic precipitator; providing a power supply that selectively varies the duty cycle of the power delivered to the electrostatic precipitator; detecting the resistivity of the particulate matter in the combustion gas stream at a location after the conditioning agent is injected but before the gas enters the electrostatic precipitator; detecting the particulate content of the gas stream after the gas stream has left the electrostatic precipitator; and selectively controlling the injection of the conditioning agent and the duty cycle of the power supply in response to the resistivity and particulate content of the gas stream.

The present approach increases the fraction of particulate matter removed from combustion gas streams and also reduces the power consumed in the gas cleanup operation. Moreover, this improved performance is achieved with a wider range of types of fuel than heretofore possible, because the behavior of the various types of particulate matter produced by different fuels can be modified so as to be more conducive to removal by an electrostatic precipitator operating in the intermittent mode of operation. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
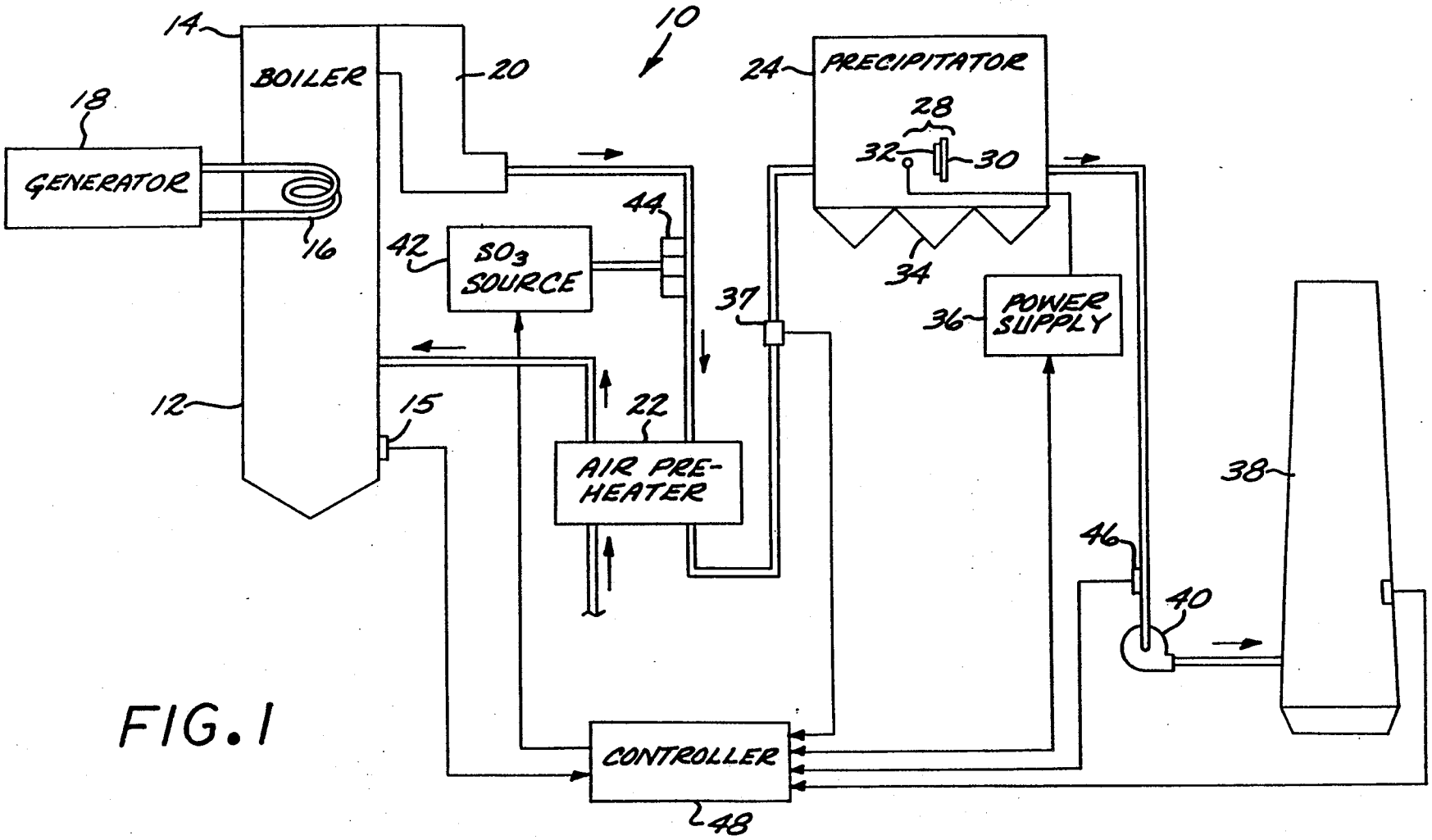
FIG. 1 is a schematic depiction of a power plant with the apparatus for removing particulate matter from the combustion gas stream.

In a power plant 10 that burns fossil fuels, oil or coal fuel is burned by a combustor 12, and the resulting hot flue or combustion gas is passed through a boiler 14, where it heats and boils water. The fuel flow to the combustor 12 is measured by a boiler load sensor 15, here a fuel flow meter. The steam generated in a loop 16 flows to a turbine-generator set 18, where electricity for consumption is produced. The steam is condensed, and the water flows back through the loop 16. The hot combustion gas stream, denoted by the arrow 20, passes through an air preheater 22, where heat is transferred from the gas stream 20 to the incoming air flowing to the combustor 12. The preheater 22 cools the combustion gas stream 20, typically from a temperature of about 750° F. to a temperature of about 300° F.

The combustion gas stream enters an electrostatic precipitator 24. In the electrostatic precipitator 24, the individual particles of unburned material in the combustion gas stream are electrically charged as they pass between a pair of highly charged precipitating elements 28, one of which is a collection electrode 30. The charged particles are attracted to the collection electrode 30, and deposit as a dust layer 32 on the collection electrode 30. The accumulated layer 32 is periodically removed from the face of the collection electrode 30 to fall into a bin 34.

A power supply 36 provides power to the precipitating elements 28. The applied voltage between the two elements 28 is typically on the order of about 30,000–55,000 volts. If the particulate in the accumulated layer 32 has too high an electrical resistivity, the back corona effect arises between the elements 28. The precipitating current is reduced, with a reduction in collection and power efficiency of the electrostatic precipitator 24.

A sensor 37 to measure resistivity of the particulate matter in the combustion gas stream may also be provided, either within the electrostatic precipitator 24 or just upstream from it, as illustrated.

The combustion gas stream, with at least a portion of the particulate matter removed, leaves the electrostatic precipitator 24 and is propelled up a gas exhaust stack 38 by a fan 40.

It has been known that the application of an intermittent voltage and current between the precipitating elements 28 can reduce the incidence of the back corona effect, resulting in improved collection and reduced power consumption of the electrostatic precipitator 24. However, it has also been the case that the effectiveness of the intermittent voltage mode of operation varied with the type of fuel burned in the combustor 12, and the nature of the resulting particulate matter. It was not previously possible to optimize the system to account for the peculiarities of different types of fuel.

In accordance with the present invention, apparatus for enhancing the economical removal of particulate matter from a combustion gas stream that is passed through an electrostatic precipitator having precipitating elements therein comprises a source of a conditioning agent including an injector adapted to add a controllable flow of the conditioning agent to a flowing combustion gas stream at a location prior to the entry of the combustion gas into an electrostatic precipitator; a power supply that controllably varies the duty cycle of the power delivered to the electrostatic precipitator; a combustion gas particulate flow rate sensor that provides a measure of the total flow rate of the particulate matter in the combustion gas stream; a combustion gas particulate concentration sensor that measures the particulate content of the gas stream after the gas stream has left the electrostatic precipitator; and a controller that controls the source of conditioning agent and the power supply responsive to the signals received from the flow rate sensor and the concentration sensor, to achieve an optimized apparatus operation according to a preselected figure of merit.

When fuel containing a high sulfur content is burned in the combustor 12, sulfur trioxide is naturally formed within the boiler and flue system. The sulfur trioxide combines with residual water vapor at the surface of the particulate matter in the gas stream to produce sulfuric acid. The sulfuric acid condenses and dissociates upon the surface of the particle, increasing the surface conductivity and reducing the resistivity of the particulate matter. The natural result is a reduction of the tendency for the occurrence of the back corona effect in the electrostatic precipitator 24.

When low sulfur fuel is burned, the amount of sulfur trioxide present in the combustion gas is insufficient to produce the required amount of sulfuric acid on the surface of the particulate matter in the combustion gas stream, leading to the back corona effect in the electrostatic precipitator 24. Intermittent excitation of the precipitating elements has been somewhat effective in reducing the adverse effects of the back corona effect.

The present invention includes a source of a conditioning agent 42 which generates a conditioning agent that modifies the surface conductivity of the ash, for addition to the combustion gas stream. The conditioning agent is most preferably sulfur trioxide, but may be ammonia or other additive.

An operable source 42 of sulfur trioxide is of the type disclosed in U.S. Pat. No. 3,993,429, whose disclosure is incorporated by reference. Briefly, in such a source as described in the '429 patent, sulfur is burned in air to produce sulfur dioxide. The sulfur dioxide is passed over a catalyst to oxidize it further to sulfur trioxide, which is then added to the combustion gas stream 20 through an injector 44. The amount of sulfur troxide injected is controllable by varying the amount of sulfur that is burned, which in turn is controllable, as by varying the speed of a pump (not shown) in the source 42.

The addition of the conditioning agent modifies the operation of the electrostatic precipitator 24 functioning in the intermittent excitation mode. The relative concentration of the particulate in the combustion gas leaving the electrostatic precipitator is measured by a combustion gas particulate concentration sensor 46. The sensor 46 is preferably an opacity meter which measures the attenuation of a beam of light passed into the combustion gas stream. Such opacity meters are well known in the industry, and an opacity meter operable for the present purposes is the model RM-41 meter made by Lear Siegler Corp.

A controller 48 receives a particulate concentration measurement signal from the sensor 46, and in the illustrated preferred embodiment a particulate flow rate signal from the sensor 15, a resistivity signal from the sensor 37, and a power consumption signal from the power supply 36. The controller 48 is preferably a programmable microprocessor with the appropriate input/output interface. The controller 48 sends control signals to the conditioning agent source 42 and the power supply 36. The signal received from the sensor 46 provides an indication of the degree to which the particulate has been removed from the combustion gas, and is a key piece of information in ensuring compliance with the environmental protection laws. The signal received from the sensor 15 provides advance warning of a change in the amount of particulate matter passing through the system, and permits the controller 48 to take prospective action to minimize adverse consequences of a resulting change in the system operation.

Figure 2:
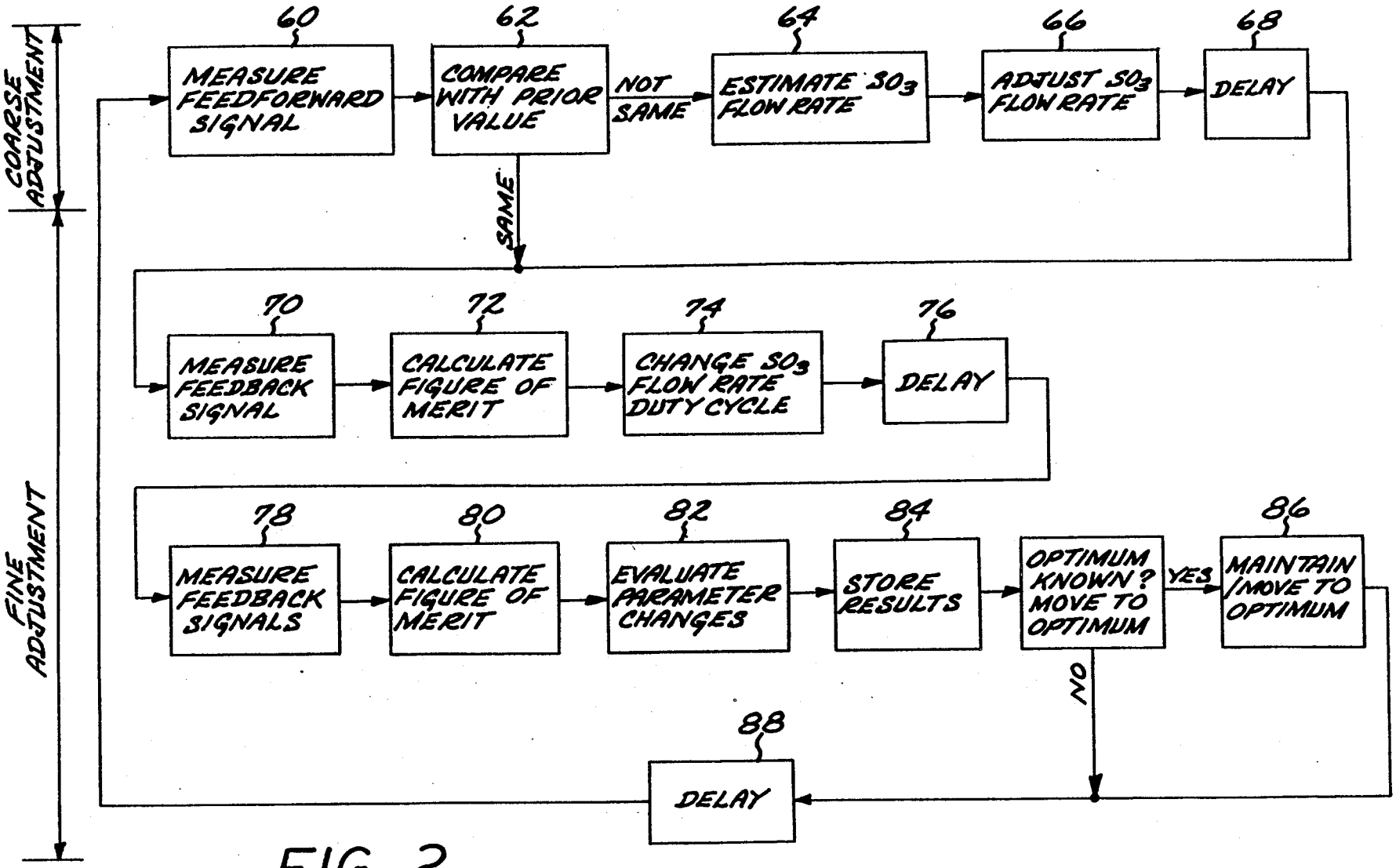
FIG. 2 is a diagrammatic flow chart for the control process for enhancing removal of particulate matter.

A preferred control approach for practicing the present invention is illustrated in FIG. 2. This control procedure is used in conjunction with the preferred apparatus of FIG. 1. The procedure is a continuously repeating loop of measurement and adjustment, having two portions. In the gross adjustment portion of the process, the feedforward boiler load signal from the sensor 15 is used to calculate and implement an approximate value for the sulfur trioxide injection flow rate. In the fine adjustment portion of the process, the feedback signals such as the particulate concentration and the electrostatic precipitator power consumption are measured, the sulfur trioxide content and power supply are adjusted responsively, the feedback signals again measured, and the effect of the adjustments assessed.

The signal of the boiler load sensor 15 is read in a feedforward measurement step 60. As with all the sensors of interest here, the signal is ordinarily a time average of values over minutes or hours, with the average value being the one used in the calculations. The signal measured in step 60 is compared, numeral 62, with the prior reading of the boiler load sensor 15. If the values are identical within some preselected difference, the next three steps are skipped. If the values are sufficiently different, the sulfur trioxide flow rate is adjusted.

In order to adjust the sulfur trioxide flow rate, the approximate required value to attain a preselected resistivity in the particulate matter is estimated, numeral 64. The estimation may be performed by any of several distinct techniques. The preferred approach is to use stored power plant data for a particular set of operations identical to those in effect, except for a change in fuel flow rate. Alternatively, an empirical equation has been developed to permit sulfur trioxide requirements to be estimated from data on the fuel flow and character of the particulate. This or other formulas may be found applicable to particular power plants, as the understanding of plant performance is improved.

$$INJ = K_0 + K_1(\mathrm{ACIDB})^a + K_2(\mathrm{EXP}\ (\mathrm{ASH})^b) + K_3(\mathrm{SUL})^c + K_4/(\mathrm{EXP}(\mathrm{ACIDB})^d) + K_5/(\mathrm{LN}(\mathrm{BARM})^e) - \mathrm{SOX}.$$

INJ is the estimated sulfur trioxide injection rate in parts per million by volume; $K_1$–$K_5$ and a–e are constants; ACIDB is the sulfur trioxide content in parts per million by volume required to reduce unconditioned fly ash resistivity to the target value, EXP( ) indicates an exponentiation to the base e (i.e., 2.718), LN( ) indicates a logarithm to the base e, ASH is the ash content of the fuel in weight percent, SUL is the sulfur content of the coal in weight percent, BARM is the ash base-to-acid ratio, molecular basis, and SOX is the sulfur trioxide content in parts per million by volume in the gas stream naturally produced by the combustion of the sulfur in the coal. A portion of the computational approach, that required to determine ACIDB, is found in R. E. Bickelhaupt, "A Study to Improve a Technique for Predicting Fly Ash Resistivity with Emphasis on the Effect of Sulfur Trioxide," U.S. Environmental Protection Agency, Research Triangle Park, North Carolina, report no. EPA No. 600/7-86/010, 1986. The values associated with the fuel and the ash are measured separately and stored in the memory of the controller 48 for each type of fuel burned in the power plant 10.

Based upon the estimated value, the controller 48 adjusts the sulfur trioxide output of the source 42, numeral 66. There follows a preselected delay 68 to permit the effect of the change in sulfur trioxide injection to propagate through the system and for the system to reach equilibrium under this new operating condition, completing the coarse adjustment.

In the fine adjustment, the sulfur trioxide injection rate and the duty cycle of the power supply 36 of the electrostatic precipitator 24 are jointly optimized by seeking the optimal performance of the system. The result reached by this fine adjustment may confirm the estimate used in the coarse adjustment, but also may be different. Thus, the coarse adjustment is used to adjust the system to a condition believed to be close to the optimum based upon prior information, but this selection does not constrain the fine adjustment portion of the process from identifying the actual optimum performance condition independent of any empirical estimate.

The feedback signals are first measured, numeral 70. The feedback signals indicated in FIG. 1 are the combustion gas particulate concentration sensor 46, the particulate resistivity sensor 37, and the power consumption of the power supply 36. Other feedback signals may also be used, as desired, relating to matters such as residual sulfur trioxide content, residual ammonia content, etc., if sensors are provided to measure these quantities.

The feedback signals are used to calculate a figure of merit, numeral 72. It is not necessarily the case that optimization would be based upon minimizing the value measured by the sensor 46, indicating maximal removal of particulate. This condition might be achieved only at an unacceptably high power consumption, increase in other pollutant levels, or other costs. The figure of merit is simply a way of expressing the optimizing factor. For example, the system performance might be optimized by maximizing the quantity (particulate removal)/(power consumption), minimizing the sum of weighted values of particulate content and gaseous pollutant content, or some more complex function. The figure of merit is the mathematical expression of the optimizing function, and is selected by the user.

Once the baseline figure of merit is established, the system operation is modified in a search procedure designed to locate the optimum system performance as defined by the figure of merit. The sulfur trioxide injection rate and the power supply duty cycle are perturbed either separately or simultaneously in a preselected manner, and the resulting change in figure of merit determined. With repetition of this procedure, the operating regime is gradually mapped, to locate the optimum performance as a function of the system variables.

By a "map" is meant a description of the performance of the system as a function of operating variables, either in tabular or mathematical form, and is preferably developed in the microprocessor. Such a map permits optimal performance to be predicted and reached more quickly and with less trial-and-error as more experience and historical data are gained.

The operating parameters of sulfur trioxide injection rate and duty cycle are first perturbed, numeral 74. After a major adjustment in the sulfur trioxide flow rate, numeral 66, the perturbation is initially random or based upon some understanding of prior behavior. As the optimization is repeated, an understanding of the mapping of system performance, as measured by the figure of merit, as a function of sulfur trioxide injection rate and duty cycle is developed. Subsequent perturbations are then used to explore unknown regions of the map or move to a known optimum. There are normally relatively few coarse adjustments of the system, with a large number of fine adjustments between coarse adjustments. It is therefore possible to map particular regions to locate optimum performance for a particular power plant output and fuel.

Figure 3:
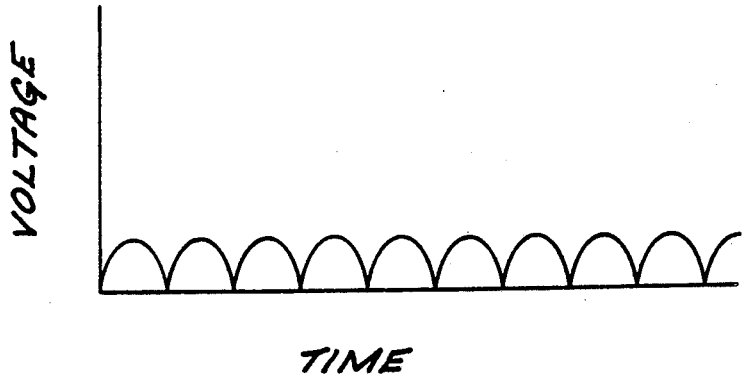
FIG. 3 is a graph of a rectified power supply output.
Figure 4:
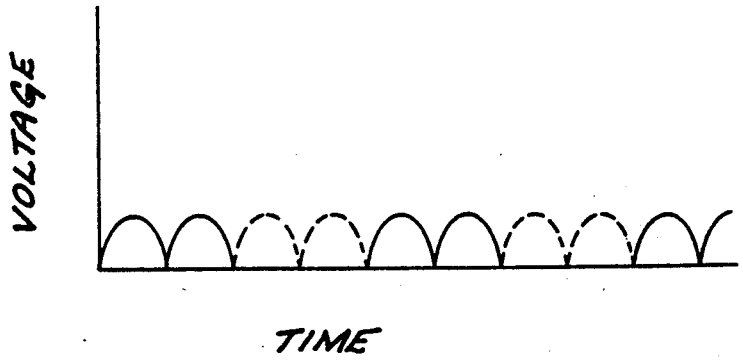
FIG. 4 is a graph of an intermittent rectified power supply output.

The preferred mode of adjustment of the electrostatic precipitator duty cycle is illustrated in FIGS. 3 and 4. The power supplied to the electrostatic precipitator 24 by the power supply 48 is preferably rectified, as shown in FIG. 3. Here the duty cycle is a full-on condition, so that each rectified half-cycle is delivered to the electrostatic precipitator 24. As shown in FIG. 4, the duty cycle can be modified to remove and eliminate some of the half-cycles. In the illustrative duty cycle of FIG. 4, two half-cycles are supplied to the electrostatic precipitator 24. There follows a period wherein two consecutive half-cycles are omitted (the omitted half-cycles being indicated in phantom lines in FIG. 4). The duty cycle of two on and two off repeats indefinitely until modified. This intermittent duty cycle takes advantage of the delay time in the formation of a back corona effect, discussed previously. The use of an intermittent duty cycle has been known previously, but not in a joint optimization approach.

After the operating parameters are perturbed, there is a delay 76 to permit the effects of the perturbation to propagate through the system and reach equilibrium. The delay may be as much as several hours for a typical large power plant.

The measurements of the feedback sensors are recorded, numeral 78, and the figure of merit calculated, numeral 80, for the newly perturbed state. These steps are respectively the same as steps 70 and 72 described previously.

The figure of merit and other relevant information for the perturbed state (as calculated at numeral 80), the prior state (as calculated at numeral 72), and any other prior states whose information is stored in the controller 48 are compared, numeral 82. A mapping of the performance of the system is developed, and the optimum point identified. All results of the analysis are stored, numeral 84.

If a sufficient mapping has been made to identify the optimum sulfur trioxide and duty cycle values reliably, the optimum values are selected and used, numeral 86. The system then maintains these values for a period of time, numeral 88, with the system performing optimally. If no optimum has been identified, or upon expiration of the time period 88, or if there is an indication of a change in the feedforward signal, the control process is repeated by proceeding to the measurement of step 60.

Even when an operating condition believed to be optimum is reached, it is desirable to periodically perturb the system to check whether any unforeseen variable has caused the optimum value to shift. If so, the new values of conditioning agent flow rate and duty system to produce the new optimum figure of merit can be determined. If not, the system can return to the previously stored optimal conditions.

The approach of the present invention permits optimization of power plant combustion gas cleanup through jointly optimized control of chemical conditioning and electrostatic precipitator performance. Although a particular embodiment of the invention has been described in detail for purposes of illustration, various modifications may be made without departing from the spirit and scope of the invention. Accordingly, the invention is not to be limited except as by the appended claims.

What is claimed is:

1. Apparatus for removing particulate matter from a combustion gas stream that is passed through an electrostatic precipitator having precipitating elements therein, comprising:

first means for selectively injecting a controllably variable amount of a conditioning agent into a combustion gas stream at a location prior to the entry of the combustion gas into an electrostatic precipitator;

second means for establishing the duty cycle of the power provided to a precipitating element in the electrostatic precipitator;

third means for measuring the relative particulate content of the combustion gas stream after it leaves the electrostatic precipitator; and fourth means for controlling the first means and the second means in response to the measurement derived from the third means.

2. The apparatus of claim 1, wherein the first means includes a source of a conditioning agent selected from the group consisting of sulfur trioxide and ammonia.

3. The apparatus of claim 1, wherein the second means includes a power controller that supplies rectified voltage to the precipitator elements.

4. The apparatus of claim 1, wherein the third means includes an opacity meter.

5. The apparatus of claim 1, wherein the fourth means is a programmable microprocessor.

6. The apparatus of claim 1, further including fifth means for determining the particulate mass flow rate in the combustion gas stream, and wherein the fourth means is further responsive to the fifth means.

7. The apparatus of claim 6, wherein the fifth means includes a boiler load sensor.

8. Apparatus for enhancing the economical removal of particulate matter from a combustion gas stream that is passed through an electrostatic precipitator having precipitating elements therein, comprising:

a source of a conditioning agent including an injector adapted to add a controllable flow of the conditioning agent to a flowing combustion gas stream at a location prior to the entry of the combustion gas into an electrostatic precipitator;

a power supply that controllably varies the duty cycle of the power delivered to the electrostatic precipitator;

a combustion gas particulate flow rate sensor that provides a measure of the total flow rate of the particulate matter in the combustion gas stream;

a combustion gas particulate concentration sensor that measures the particulate content of the gas stream after the gas stream has left the electrostatic precipitator; and a controller that controls the source of conditioning agent and the power supply responsive to the signals received from the flow rate sensor and the concentration sensor, to achieve an optimized apparatus operation according to a preselected figure of merit.

9. The apparatus of claim 8, wherein the conditioning agent is sulfur trioxide.

10. The apparatus of claim 9, wherein the power supply includes a rectifier that produces a series of rectified half-waves, and the duty cycle of the electrostatic precipitator is defined, at least in part, by a number of sequential half-waves provided to the electrostatic precipitator and a time between the sequences of half-waves.

11. The apparatus of claim 10, wherein the combustion gas is produced in a boiler, and the combustion gas particulate flow rate sensor is a boiler load sensor.

12. The apparatus of claim 11, wherein the boiler load sensor measures the fuel flow to the boiler.

13. The apparatus of claim 8, wherein the combustion gas particulate concentration sensor is an opacity meter that measures the opacity of the combustion gas after it has left the electrostatic precipitator.

14. The apparatus of claim 8, wherein the controller utilizes the signal of the flow rate sensor as a basis for the gross adjustment of the source of the conditioning agent.

15. The apparatus of claim 14, wherein the controller utilizes the signal of the concentration sensor as a basis for the fine adjustment of the source of the conditioning agent and the adjustment of the power supply.

16. The apparatus of claim 8, wherein the controller utilizes an empirical regression equation to estimate the amount of conditioning agent to be added to the combustion gas stream.

17. The apparatus of claim 16, wherein the controller utilizes a figure of merit calculation in its control algorithm.

18. The apparatus of claim 17, wherein the figure of merit of the controller includes a relationship that is based upon at least one of the quantities particulate content of the gas stream after it has left the electrostatic precipitator, non-visible pollutant content of the gas stream after it has left the electrostatic precipitator, and power consumption of the electrostatic precipitator.

19. A process for removing particulate matter from a combustion gas stream that is passed through an electrostatic precipitator, comprising the steps of:

injecting a controllable flow of a conditioning agent to a flowing combustion gas stream at a location prior to the entry of the combustion gas into an electrostatic precipitator;

providing a power supply that selectively varies the duty cycle of the power delivered to the electrostatic precipitator;

detecting the resistivity of the particulate matter in the combustion gas stream at a location after the conditioning agent is injected but before the gas enters the electrostatic precipitator;

detecting the particulate content of the gas stream after the gas stream has left the electrostatic precipitator; and selectively controlling the injection of the conditioning agent and the duty cycle of the power supply in response to the resistivity and particulate content of the gas stream.

* * * * *